United States Patent [19]
Ackley, Sr. et al.
[11] 4,193,343
[45] Mar. 18, 1980

[54] PELLET MARKING APPARATUS WITH FRAME RAISING AND LOWERING MECHANISM

[75] Inventors: Charles E. Ackley, Sr., Oreland; Charles E. Ackley, Jr., Philadelphia, both of Pa.

[73] Assignee: R. W. Hartnett Company, Philadelphia, Pa.

[21] Appl. No.: 891,292

[22] Filed: Mar. 29, 1978

[51] Int. Cl.² ..... B41F 17/36
[52] U.S. Cl. ..... 101/35; 101/154; 101/169; 101/218; 101/351; 74/613
[58] Field of Search ..... 101/35–37, 101/38 R, 38 A, 39, 40, 154, 157, 152, 153, 150, 151, 169, 351, 352, 350, 425, 217, 218, 247, 357, 361, 345, 341, 330, 331; 74/613

[56] References Cited

U.S. PATENT DOCUMENTS

| | | | |
|---|---|---|---|
| 1,269,794 | 6/1918 | Dausmann | 101/157 |
| 1,472,307 | 10/1923 | Moffett | 101/350 X |
| 1,496,331 | 6/1924 | Wheelock | 101/350 X |
| 1,504,409 | 8/1924 | Yetter et al. | 101/152 |
| 1,883,258 | 10/1932 | Wood | 74/613 X |
| 1,958,128 | 5/1934 | Cate | 74/613 UX |
| 2,386,029 | 10/1945 | Zuckerman | 101/152 X |
| 2,859,689 | 11/1958 | Ackley | 101/35 |
| 2,870,705 | 1/1959 | Smith | 101/152 |
| 2,898,849 | 8/1959 | Gillies | 101/157 X |
| 3,066,784 | 12/1962 | Remington et al. | 101/40 UX |
| 3,136,245 | 6/1964 | Klingelfuss | 101/152 |
| 3,304,863 | 2/1967 | Jurny | 101/351 |
| 3,589,280 | 6/1971 | Wilde | 101/350 X |
| 3,738,265 | 6/1973 | Saveressig | 101/152 |

FOREIGN PATENT DOCUMENTS

| | | | |
|---|---|---|---|
| 522792 | 4/1955 | Italy | 101/157 |

*Primary Examiner*—Clifford D. Crowder
*Attorney, Agent, or Firm*—Miller & Prestia

[57] ABSTRACT

In a pellet marking apparatus of the type comprising, a frame, printing means comprising a design roller and a resilient printing roller mounted on the frame, an ink reservoir mounted on the frame, hopper means into which a multiplicity of pellets or the like are to be loaded, and a conveyor for transporting the pellets from the hopper and presenting them to the printing means for marking the pellets with the desired indicia, the improvement comprising hinge means for moving the printing means between an operative position in which the design roller is immersed in the ink reservoir and the printing roller is in position to contact pellets on the conveyor, and a dwell position in which the design roll is not in contact with the reservoir and the printing roller is spaced from the conveyor in a position so as not to contact pellets thereon. The hinge means functions to permit quick replenishment of the ink reservoir when dry without necessitating removal of the design roll, printing roll, or any other member from the mechanism.

18 Claims, 10 Drawing Figures

28
31
30
81
91
92
126
26
90
87
124
24
12
18
40
42
38
36
120
65
64
122
128
8
51
44
75
72
76
68
63
66
53
50
10
114
112
142
140
82
82(b)
144
102
100
108
110

PELLET MARKING APPARATUS WITH FRAME RAISING AND LOWERING MECHANISM

BACKGROUND OF THE INVENTION

1. Field of the Invention

The present disclosure relates to an improved pellet marking apparatus of the type adapted to imprint certain desired indicia such as trademarks, trade names, lot numbers, or control numbers, on or around the surface of a multiplicity of pellets or the like as the pellets are transported, by way of a conveyor or the like, adjacent the surface of the printing roller. The improved apparatus is characterized by the provision of a hinged connection linking both the printing roller and the design roller with the ink reservoir. In accordance with the invention, the design roller and printing roller are movable between two positions corresponding to operational and dwell states. In the operational state, the design roller is immersed in the ink reservoir to receive ink therefrom. When the reservoir needs replenishing, the design roller is pivotally moved from immersion in the reservoir to a position in which it does not contact the reservoir. Thus, the hinged connection provides easy access to the reservoir so that it can be filled quickly and easily without necessitating disassembly of any part from the mechanism.

2. Prior Art

Many printing mechanisms that are adapted to transport and print upon a multiplicity of uniformly shaped and sized objects are known in the art.

One such device is disclosed in U.S. Pat. No. 2,859,689 (Ackley). Other prior art printing mechanisms include those disclosed in U.S. Pat. Nos. 3,868,900 (Ackley); 3,871,295 (Ackley) and 3,931,884 (Ackley).

Basically, in all of the above listed prior art patents, the objects, such as tablets, capsules, pills, and uniformly shaped confectionary products, are transported from a hopper to the printing means by means of an endless conveyor. The printing means usually include a design roller comprising etched portions therein, which etched portions correspond to the desired marking or indicia with which the objects are to be imprinted. The etched portions of the design roller pick up ink from the ink reservoir as the design roller is immersed therein. The design roller contacts a rotatable printing roller so that the ink picked up by the etched portions of the design roller is transferred to the surface of the printing roller.

As the objects pass beneath the printing roller, the desired indicia are imprinted thereon.

In some cases, such as in the printing of capsules which comprise body portions and cap portions of larger diameter than the body portions, it is desirable to "rectify" the capsules prior to their presentment adjacent the printing means. Rectification, as used in the art, refers to a condition in which capsules or objects are all similarly disposed, with the cap portions of all of the capsules extending in one predetermined direction and the body portions extending in another predetermined direction. In this manner, it is possible to uniformly print upon similar portions of each capsule. For instance, a trademark may be imprinted on the same cap portion location of each capsule or the desired indicia may be imprinted only on body portions or on specific loci of both the cap portions and body portions alike.

Also, many of the prior art printing devices are capable of effecting "wrap around" type printing whereby the objects are spun about their axes as they contact the printing roller. Accordingly, in this manner, printing about the circumference or a portion thereof of the objects may readily be effected. In wrap around printing operations, the surface speed of the printing roller is adjusted so that it exceeds the speed of the conveyor that presents the objects thereto. Accordingly, as the printing roller contacts the advancing objects, the objects are spun about their longitudinal axes. To aid in spinning movement of the objects, specially designed pocket members, designed to receive the objects therein, are carried by the conveyor. These pocket members themselves are the subject of our co-pending application, Ser. No. 859,303, filed Dec. 12, 1977.

These prior art printing devices are not without disadvantages, however. In all of the devices, the location of the ink reservoir on the frame makes it relatively inaccessible and when the reservoir needs replenishment, various members, such as the design roll itself, must be removed from the mechanism to permit access to the reservoir. Not only does the step of physically removing certain parts from the mechanism result in lengthy interruption of the printing process, but the parts when replaced after replenishment must be precisely adjusted so that the design roll and printing roller cooperate to properly imprint the desired indicia on the desired portion or portions of the pellet or the like. The proper alignment between the design and printing rolls is critical since, during the printing process, the ink is transferred from the design roller to the printing roller and then to the objects as they pass beneath the printing roller. Thus, after replenishment, if the design roller is not repositioned in exact alignment with respect to the printing roller and the objects, the desired printing will not appear on corresponding portions of the objects. This condition is completely unacceptable commercially and results in substantial economic loss.

Accordingly, there is a great need in the art for a device which will permit ready access to the ink reservoir for easy replenishment thereof, without requiring disassembly of any parts from the mechanism.

Further, despite the advantages afforded by these prior art devices, there remains a need for means for providing precise adjustment of the alignment between the design and printing rollers while both of these members are journalled in the frame.

A mechanism which can provide this adjustment while the machine is running is even more desirable.

Also, the operation of the prior art devices may be, in some respects, dangerous for the operator since sharp edged doctor blades wipe excess ink from the design roll and since the mechanism in general and specifically the nip between the design roll and printing roll are capable of injuring a finger or the like that is carelessly placed therein.

Accordingly, it is an object of the present invention to provide an improved printing mechanism wherein replenishment of the ink reservoir is relatively easy and does not require the disassembly of any part whatsoever from the mechanism.

It is another object of the present invention to provide a means for adjusting the alignment between the design and print rollers.

It is an even more specific object of the present invention to provide a means for adjustably aligning the design roller longitudinally with respect to the printing roll that does not require the machine to be shut down while adjustment is effected.

Further, it is another object to provide varied safety devices that protect the operator from sharp edges of certain components and the nip between the design and printing rollers, which mechanisms can shut down the printing drive altogether when actuated.

These and other objects are met by the improved printer disclosed herein. The construction of the improved apparatus will become apparent in the following description and in the drawings.

In the drawings,

DRAWINGS

DETAILED DESCRIPTION

Figure 1:
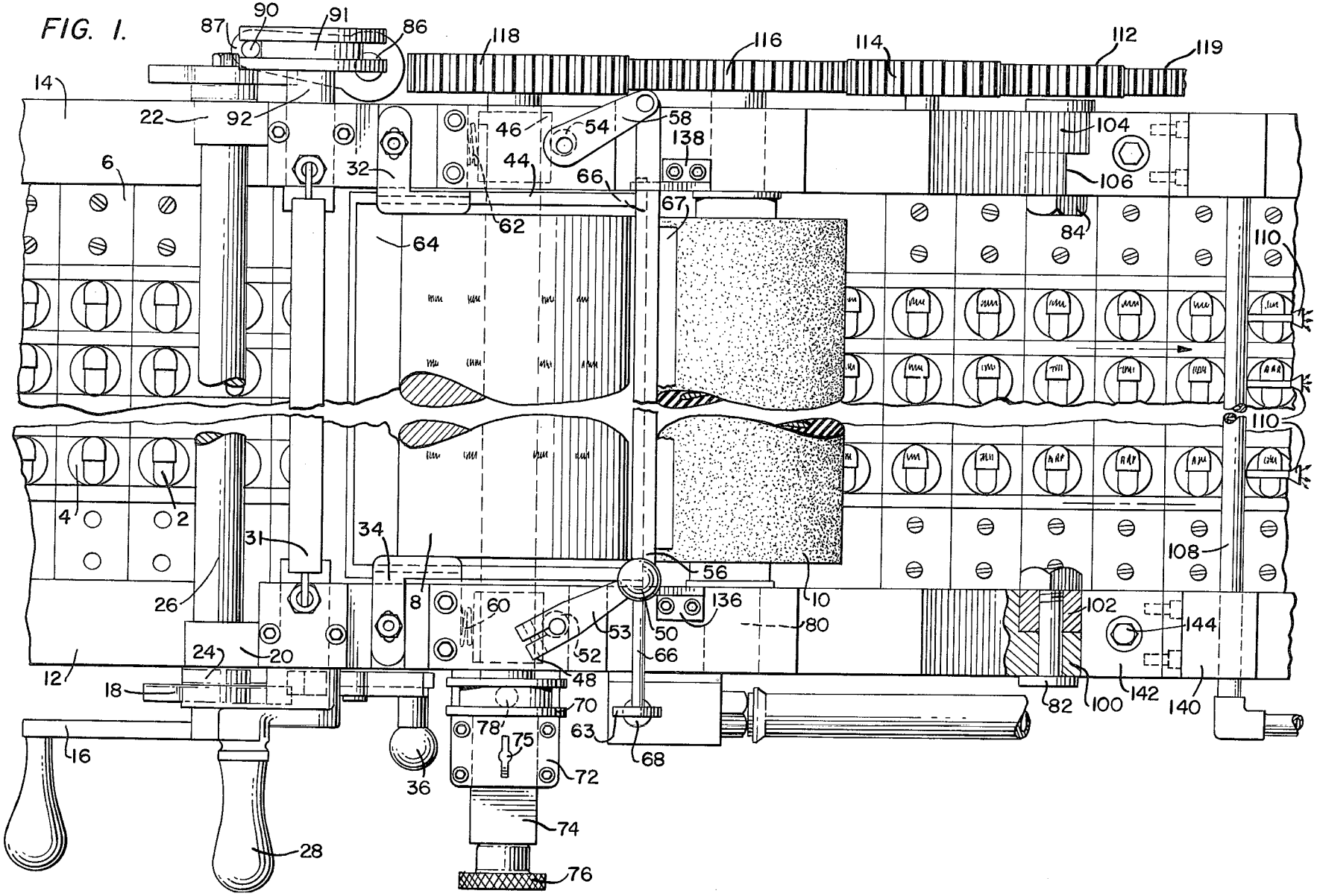
FIG. 1 is a plan view of the improved printing apparatus in accordance with the invention, with certain parts being shown in phantom.

The following description is not intended to limit the scope of the invention, as defined in the appended claims, but will be presented in specific terms in order more clearly to describe the construction and operation of the particular forms of the invention that have been selected for illustration in the drawings.

It is to be understood that the improved marking mechanism as herein disclosed is capable of printing upon many uniformly shaped articles including, but not limited to, tablets, pills, capsules, and certain confectionery products. As used throughout the specification and claims, the term "pellets" is used in a generic sense to cover all such articles and equivalents thereof.

The basic printing mechanism, over which the present disclosure provides significant improvements, is disclosed in U.S. Pat. No. 2,859,689 (Ackley), which patent is hereby incorporated by reference.

With respect to FIG. 1 of the drawings, there is shown a plurality of capsules 2 disposed in pockets 4 carried by an endless conveyor 6. As indicated in the Figure, the capsules are carried toward the right by the conveyor 6 and pass beneath design roller 8 and printing roller 10 whereby the desired indicia are imprinted upon the capsules 2 as they pass underneath and adjacent the printing roller 10.

The mechanism comprises lower frame members 12, 14, with the conveyor 6 running therebetween. Crank arm 16 is connected to bell crank 18 which functions to actuate pivotal movement of upper frame members 20, 22 in a manner which will be fully described hereinafter. Bell crank 18 carries linkage arm 24 which linkage arm in turn is mounted on transversely positioned shaft 26 journalled in the upper frame members 20, 22.

Doctor blade pivot arm 28 controls pivotal movement of doctor blade 30 (FIG. 2) between a position in which the blade 30 contacts design roll 8 to remove excess ink therefrom and a position in which the blade 30 is vertically disposed beneath safety shield 31 mounted to the upper frame members 20, 22.

As described in U.S. Pat. No. 2,859,689 (Ackley), means are provided for transversely reciprocating the doctor blade 30 along the longitudinal axis of the design roller 8 so as to wipe excess ink therefrom. Vertical shaft 86 carries finger 90 that is tracked in spool 91. Spool 91 is mounted to doctor blade shaft 92.

Wiper blades 32, 34 are fixedly mounted to upper frame members 20, 22 respectively to wipe excess ink from the sides of the design roller 8.

Lever 36, pivotally mounted on lower frame member 12, carries a dog 38 (FIG. 2) that engages either one of the notches 40, 42 (FIG. 2) on the bell crank 18 to secure the upper frame members 20, 22 in the "dwell" position.

Design roll 8 is mounted on shaft 44 that is journalled in slidable bearings 46, 48. Arm 50 carrying eccentric 52 and eccentric 54 through linkage 56 and connecting arm 58 provide a means for moving the design roll 8 to the right and left with respect to FIG. 1 so that the design roll 8 can be moved into and out of engagement with printing roller 10. Coil springs 60, 62 bias shaft 44 toward printing roller 10.

As shown in FIG. 1, ink reservoir 64 is disposed below design roller 8 so that a portion of the roller 8 may be immersed therein to pick up ink that is then transferred to the printing roller 10 when the rollers 8 and 10 are in engaging relationship.

Transverse safety bar 66 and associated safety blade 67 extend across the upper frame members 20, 22 and when contacted by the operator's hand etcetera, the associated microswitch comprising cam 68 shuts off the drive for the mechanism.

A means for transversely adjusting the position of the design roller 8 with respect to the longitudinal axis of the printing roller 10 is also shown in FIG. 1. The structure and functioning of this means will be fully described hereinafter although in this Figure, one can see that spool 70 is mounted on shaft 44 and that bracket 72 is cantilevered to frame 20. Sliding bar 74 and associated actuator screw 76 carry finger 78, which finger 78 is tracked in the spool 70 so that adjustment of the design roller 8 is possible along a direction parallel to the longitudinal axis of shaft 80 of the printing roller 10.

As further shown in FIG. 1, a hinged joint between the lower and upper frames is provided. Bolt 82 is fit through joint 100 of the upper frame and joint 102 of the lower frame. Whereas bolt 84 is inserted through joint 104 of the upper frame and joint 106 of the lower frame. Pivotal movement of the hinged joint between "operational" and "dwell" states is actuated by manual engagement of the bell crank 18 and its associated mechanisms.

Manifold 108 and communicating fluid nozzles 110 blow air against the capsules 2 as shown by the arrows in FIG. 1 to aid in easy ejection of the capsules from the pockets 4.

Means for rotating the rollers 8 and 10 are detailed in the aforementioned U.S. Pat No. 2,859,689. These means comprise an electric motor which drives a pulley through a belt so as to actuate drive for the meshing gears 112, 114, 116, and 118.

Figure 2:
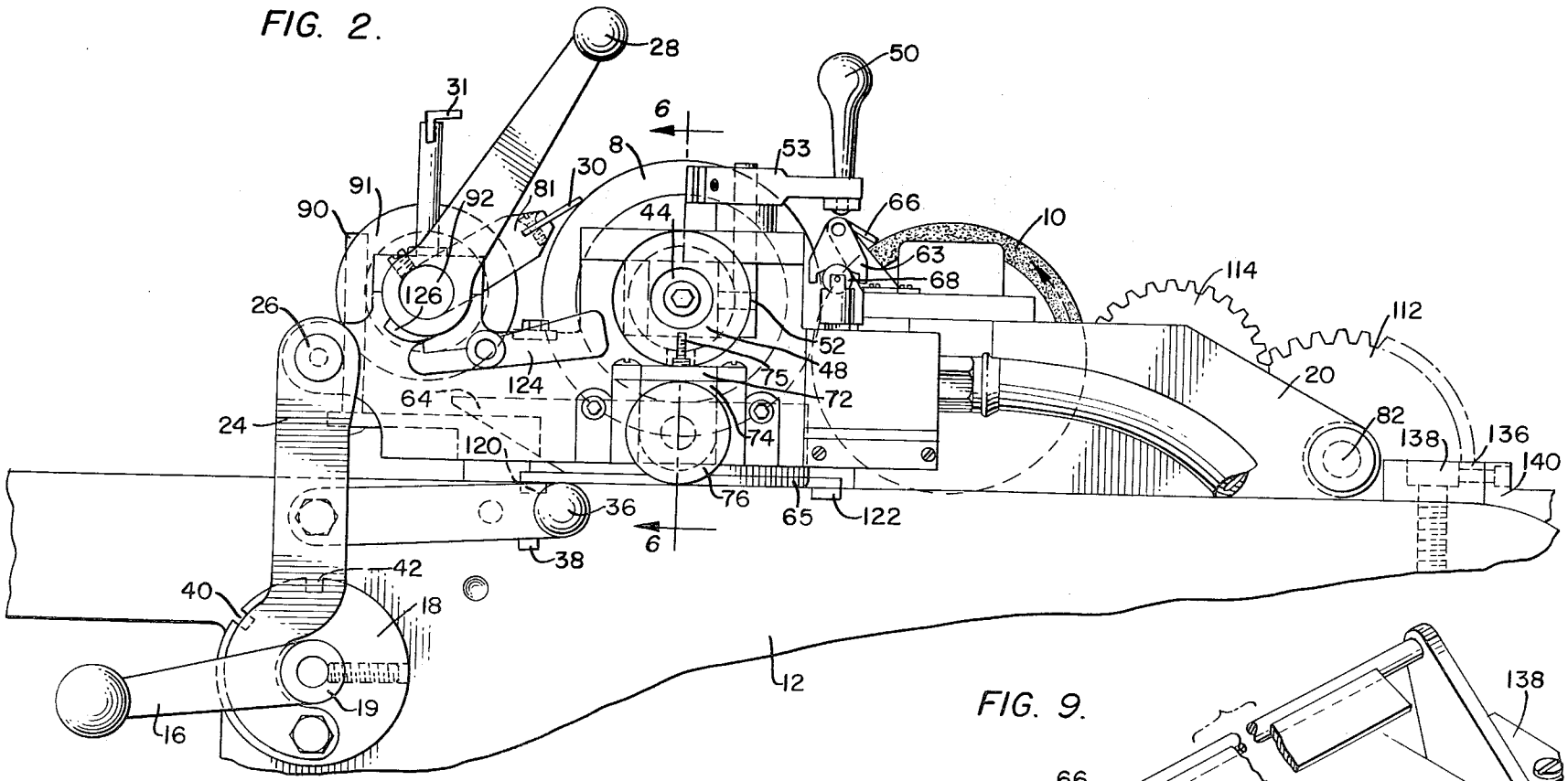
FIG. 2 is a side elevational view of the improved apparatus in the "operational" state.

With respect to FIG. 2, the improved mechanism of the present invention is shown in its "operational" condition i.e., with a portion of the design roller 8 being immersed in reservoir 64 and with printing roller 10 in position to contact conveyed pellets. The reservoir 64 and integral tray 65 are demountably positioned in recesses 120, 122 for easy removal of the reservoir.

In this view, doctor blade 30 carried by clamp 81 is shown in engagement with design roller 8. It is to be remembered that the doctor blade 30 is covered by shield 31 when the blade 30 is moved upwardlly (with respect to the position shown in FIG. 2) via the pivot arm 28. A safety latch 124 is provided to engage dog 126 of the arm 28 to secure the blade 30 in its safety position under the shield 31.

Figures 3, 10:
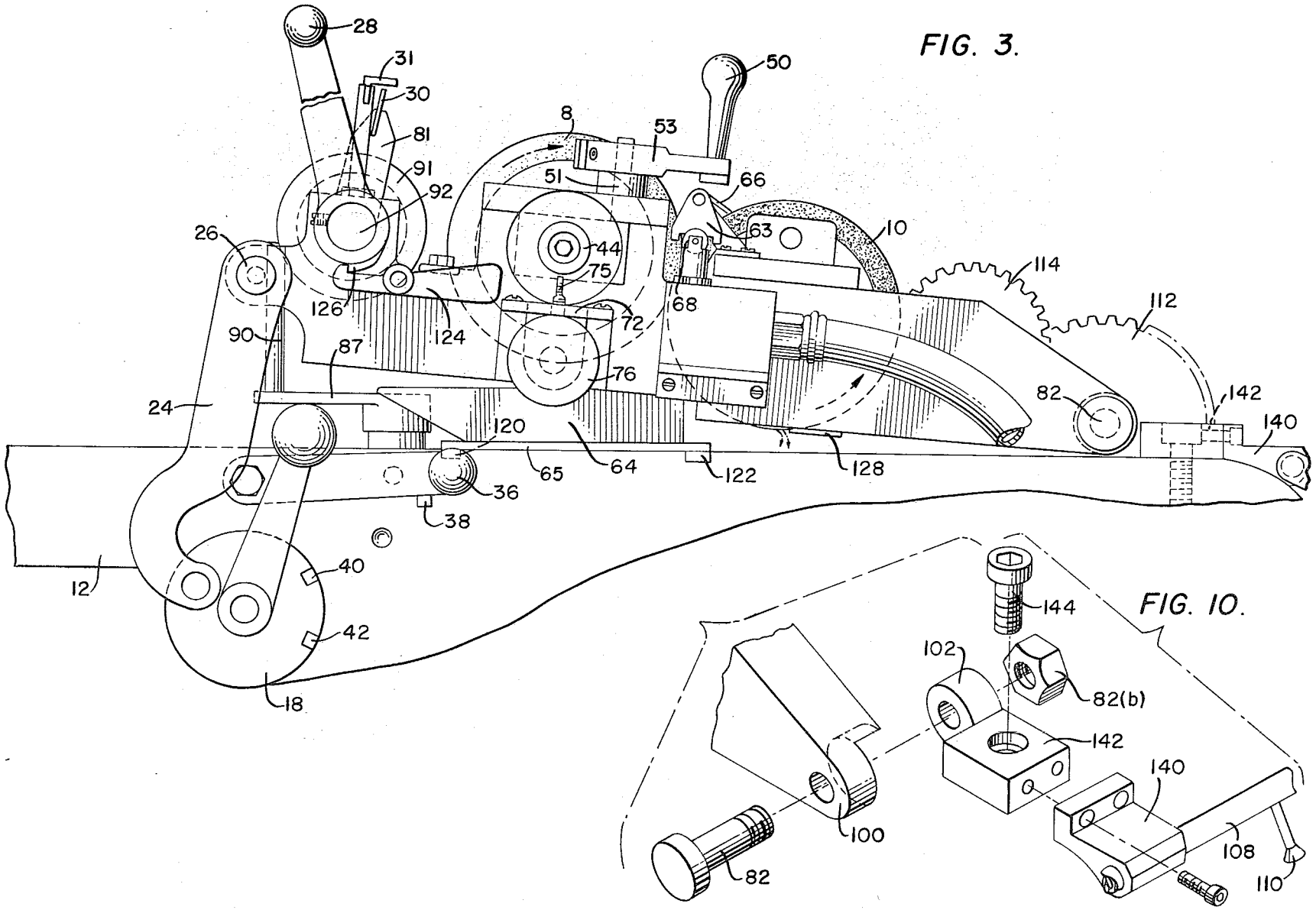
FIG. 3 is a side elevational view of the apparatus taken from the same side as shown in FIG. 2, but showing the apparatus in the "dwell" state.
FIG. 10 is an exploded perspective view of the hinged connection which couples the printing means and the ink reservoir in accordance with the invention.

In FIG. 3, the mechanism is shown in its "dwell" state, with the upper frame and members mounted thereon raised above the lower frame so as to permit easy access to the ink reservoir 64 for replenishment thereof. It will be seen that the printing roller 10 is raised to a position so as not to contact pellets on the conveyor. This is an important part of the invention since there is now no need to remove any component from the mechanisn in order to replenish the ink supply. For increased safety, the lever 36 should be rotated approximately 90° to the left of the position shown in FIG. 3 so that dog 38 is received in one of the notches 40, 42 to secure the upper frame members 20, 22 in the "swell" position.

It is to be noted that the arm 28 is secured through engagement of latch 124 and dog 126. Also apparent in FIG. 3 is the provision of stripper 128 which is mounted on the upper frame 20 to strip any capsules from the printing roll 10 in the case that the capsules mementarily adhere thereto after they have been printed.

Figure 4:
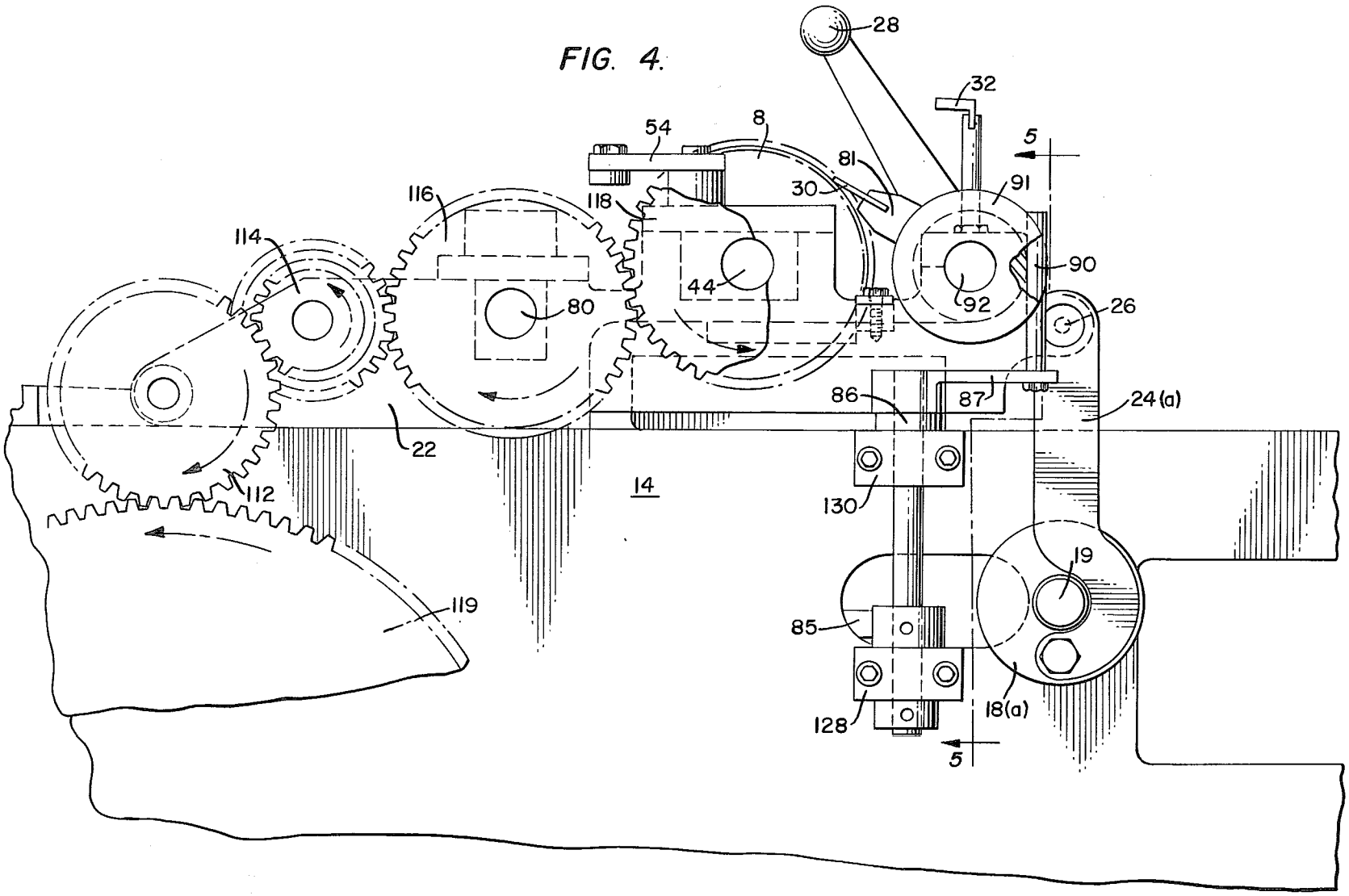
FIG. 4 is a side elevational view of the apparatus in the "operational" state, taken from the side opposite from that shown in FIGS. 2 and 3.

In FIG. 4, the mechanism is shown from the drive train side thereof in its "operational" condition. Rotation of gear 119 is actuated by a pulley (not shown) driven by an electric motor (not shown) but described and shown in the aforementioned U.S. Pat. No. 2,859,689. The drive side of the mechanism is provided with bell crank 18(*a*) and crank link arm 24(*a*) which function in cooperation with the bell crank 18 and crank link arm 24 positioned on the opposite machine side through common shaft 19 to actuate raising and lowering of the upper frame members 20, 22.

Figure 5:
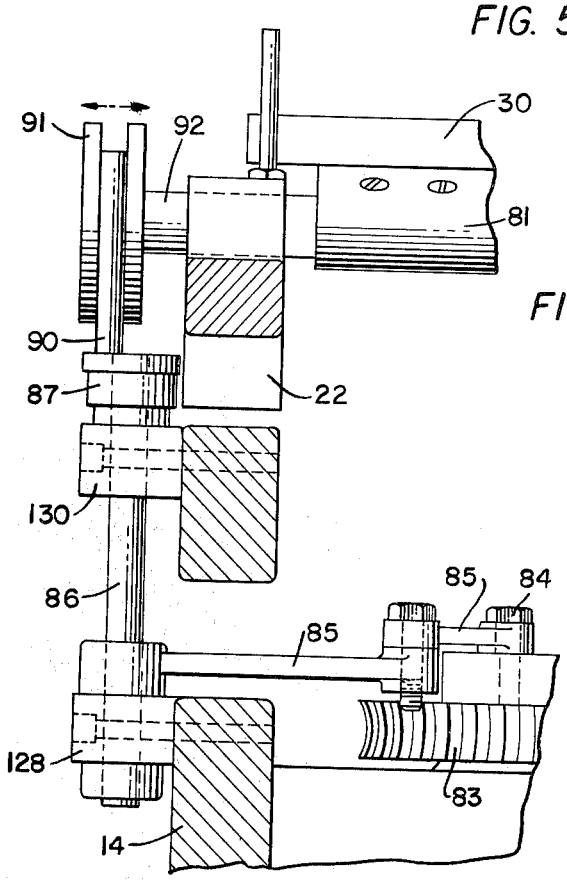
FIG. 5 is a sectional view taken along the lines and arrows 5—5 of FIG. 4, showing the means for oscillating the doctor blade back and forth along the longitudinal axis of the design roll.

With respect to FIGS. 4 and 5, there is shown a mechanism for operating a wiping device for removing excess ink from the design roller 8 as described in U.S. Pat. No. 2,859,680. The wiping device comprises doctor blade 30 which is carried in transversely reciprocal clamp 81. The reciprocating mechanism includes a worm (shown in FIG. 2 of the referenced patent) driven from the power drive mechanism (as shown in FIG. 2 of the referenced patent) meshing with the worm gear 83 carrying a pivot 84 which reciprocates a bell crank lever 85 connected through vertical shaft 86 housed in brackets 128, 130, to a lever 87 having a finger 90 tracking in the spool 91 on the shaft 92. Accordingly, it will be appreciated that the doctor blade 30 reciprocates longitudinally of the design roller 8 as it wipes excess ink therefrom.

Figure 8:
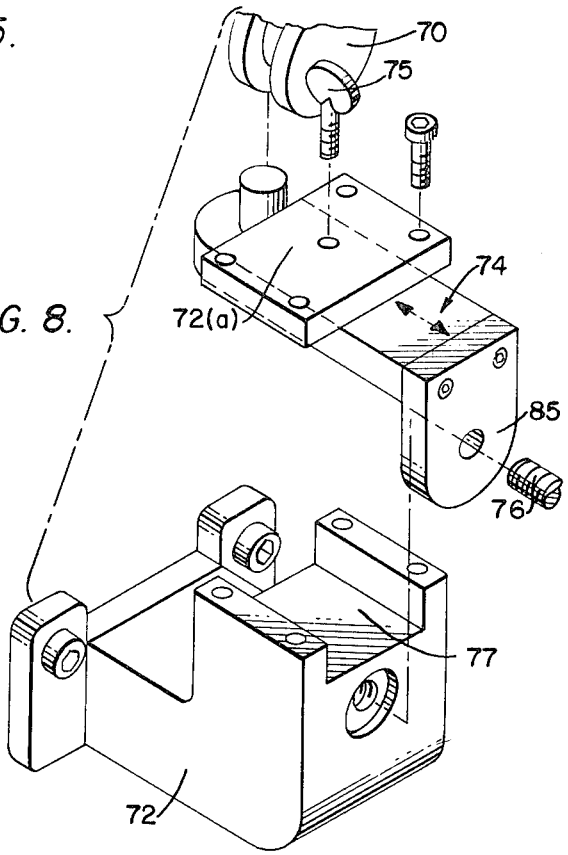
FIG. 8 is an exploded perspective view of certain components of the means for adjustably aligning the position of the design roll longitudinally with respect to the printing roll, which means are also shown in FIG. 6.
Figure 6:
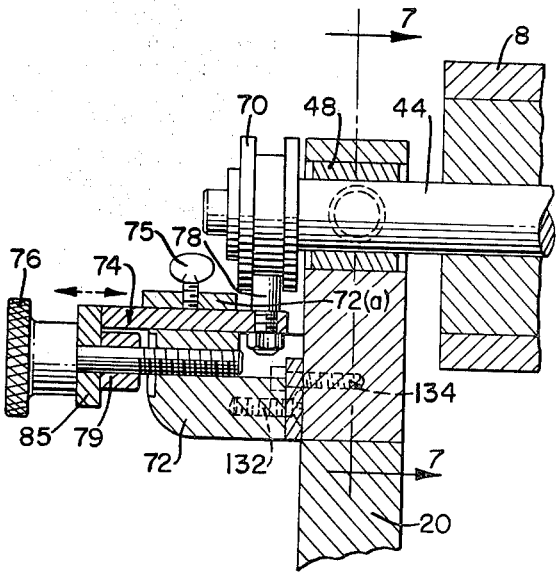
FIG. 6 is a partially cut away detailed view of the means for adjustably aligning the position of the design roll longitudinally with respect to the printing roller in accordance with the invention.

Turning now to FIGS. 6 and 8, the mechanism for providing adjustment of the design roller 8, longitudinally with respect to the printing roller 10 is shown. This mechanism provides significant advantages since the position of the design roller 8 can be adjusted even when the machine is operating. Further, it allows precise alignment between the design and printing rollers which is critical to proper printing upon the capsules or other objects, as the objects are often passed in an array beneath the printing roller and thus the design roll must transfer the ink to those portions of the printing roll which will pass over and touch the objects.

As shown in FIGS. 6 and 8, the means for providing adjustment of the design roller longitudinally with respect to the printing roller includes a bracket 72 cantilevered to frame 20 by bolts 132, 134. Slidable bar 74 is slidably received in the bracket 72 with bracket plate 72(*a*) bolted to the bracket 72 to position the bar 74 in the channel 77 of bracket 72. Finger 78, carried by the slidable bar 74, is tracked in spool 70 on the shaft 44 of design roller 8. Actuator screw 76 is fit through boss 85 of bar 74 and threaded to the bracket 72. The screw is provided with a stop 79 which bears against the boss 85 to actuate sliding motion of the bar 74 when the screw 76 is turned. Set screw 75 is threaded through plate 72(*a*) and acts as a means for securedly holding the desired positional adjustment of the design roller 8.

Figure 7:
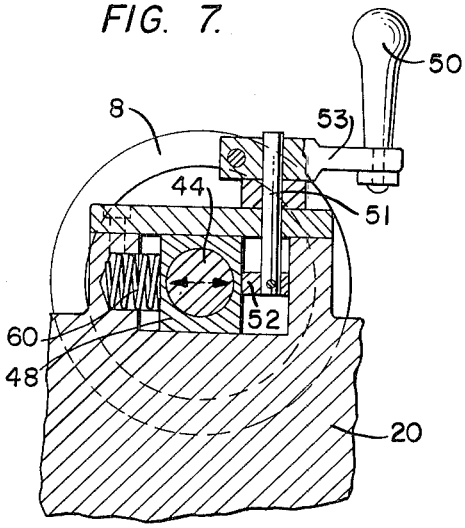
FIG. 7 is a sectional view taken along the lines and arrows 7—7 of FIG. 6.

With reference to FIG. 7, there is shown the means for moving the design roller 8 into and out of contact with the printing roller 10. Eccentric 52 carried by arm 50 through lever 53 and pin 51 bears against the slidable bearing 44. Coil spring 60 biases the bearing and thus the design roller 8 to a position in which the roller 8 will touch and transfer ink to the printing roller 10.

Figure 9:
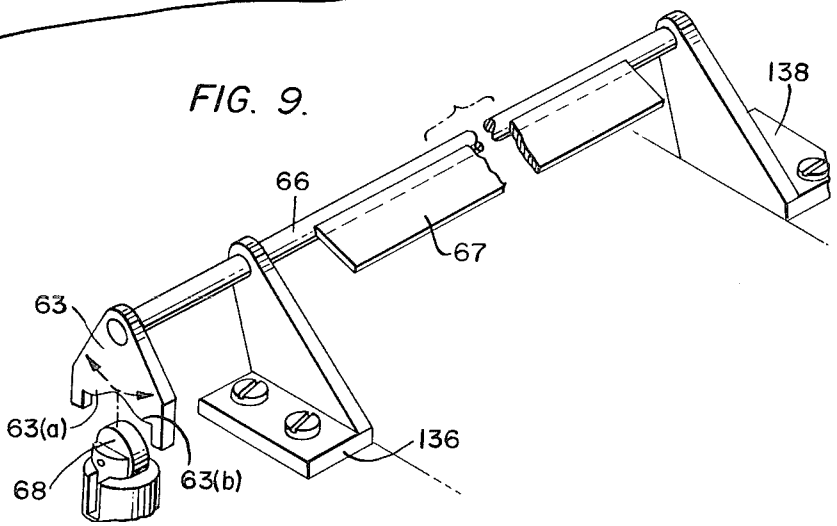
FIG. 9 is an exploded perspective view of the safety mechanism in accordance with the invention.

FIG. 9 shows the safety means in accordance with the invention. The safety bar 66 and associated blade portion 67 are mounted in brackets 136, 138 that are secured to the frame. Cam follower 63 is carried by the bar 66 and contacts cam 68 of the microswitch assembly. Tilting of the cam follower 63 by the inadvertent placement of a hand or the like on the bar 66 or blade 67 will halt the drive for the marking mechanism as the rounded portion 63(*a*), 63(*b*) of the follower 63 press the cam 68 downwardly to activate a switch which cuts the electric power to the drive motor.

With respect to FIG. 10, there is shown the hinged connection which couples the upper frame with the lower frame. Bolt 82 is fit through joint member 100 of the upper frame and joint member 102 of the lower frame. Nut 82(*b*) secures bolt 82. Joint member 102 is provided with a plate portion 142 through which bolt 144 is threaded to anchor joint member 102 to lower frame member 12. Fluid manifold bracket 140, carrying manifold 108, is secured to the front of the plate 142.

It is to be pointed out that the improved marking mechanisms herein disclosed may be used to imprint the desired indicia upon any objects which are uniformly shaped and capable of being transported by a conveyor or the like. Capsules, pills, tablets, and confectionery products may be advantageously printed upon with the disclosed apparatus but it must be remembered that the term "pellet" as used throughout the specification and claims is used to cover all such objects.

Further, the printing mechanism herein disclosed is advantageously used regardless of whether the pellets have been rectified (as the term is hereby defined) prior to their presentment to the printing roller.

Still further, the printing mechanism of the present invention can be used in wrap around printing applications wherein the pellet is rotated about its longitudinal axis during printing or the printing mechanism can be used in non-"wrap around" printing applications.

Those skilled in the art may be capable of designing hinged connections and means for actuating raising and lowering motion of the upper frame members relative to the lower frame other than those illustrated in the drawings and described in the specification. Further, other safety means and means for adjusting the position of the design roll longitudinally with respect to the print roller may be provided by those skilled in the art. The appended claims are intended to cover all such equivalent mechanisms.

It will be appreciated that other modifications may be made in the form of the improved pellet marking device herein disclosed, including reversal of parts, and substitution of other equivalents, and the use of certain features of the invention may be used independently of others, all within the spirit and scope of the invention as defined in the appended claims.

We claim:

1. In a pellet marking mechanism of the type having a frame, an ink reservoir mounted on said frame, printing means comprising a design roller and a printing roller both connected to said frame, hopper means into which a multiplicity of pellets or the like are to be loaded, and conveyor means for transporting said pellets from said hopper and presenting them to said printing roller so that the desired indicia are imprinted thereon, the improvement comprising:

(a) pivot means for selectively moving said printing means between (1) an operative position in which said design roller contacts said ink reservoir to receive ink therefrom and in which said printing roller is in position to contact pellets on said conveyor, and (2) a dwell position in which said design roller is spaced from said ink reservoir and said printing roller is spaced from said conveyor in a position so as not to contact pellets thereon, and (b) locking means cooperating with said pivot means for securing said printing means in said dwell position when desired.

2. An improved pellet marking mechanism as recited in claim 1 wherein said pivot means comprise a hinged connection connecting said printing means to said conveyor and said ink reservoir.

3. An improved pellet marking mechanism as recited in claim 2 said pivot means comprise a means for actuating movement of said printing means between said operative and dwell positions, said actuation means comprising a bell crank and crank arm attached to said bell crank.

4. An improved marking mechanism as recited in claim 3 wherein said locking means comprise a lever pivotally mounted on said frame and carrying a dog member and wherein said bell crank includes notches therein, said dog engageable with said notches to securely hold said printing means in said dwell position.

5. An improved pellet marking mechanism as recited in claim 2 further including ejection means for ejecting said pellets from said transport means after said pellets have been presented to said printing roller.

6. An improved pellet marking mechanism as recited in claim 5 wherein said ejection means comprises a fluid jet.

7. An improved pellet marking mechanism as recited in claim 1 wherein said printing roller and said design roller are positioned in parallel relation to each other on said frame, said marking mechanism further comprising positional adjustment means connected to said design roller for adjusting the position of said design roller along the axial direction thereof.

8. An improved pellet marking mechanism as recited in claim 7 further including means attached to said design roller for moving said design roller into and out of contact with said printing roller.

9. An improved pellet marking mechanism as recited in claim 8 wherein said design roller is journalled in a slidable bearing on said frame and wherein said means for moving said design roller into and out of contact with said printing roller comprises an eccentric engaging said slidable bearing.

10. An improved pellet marking mechanism as recited in claim 9 further including a coiled spring positioned adjacent said slidable bearing to bias said design roller toward a position in contact with said printing roller.

11. An improved pellet marking mechanism as recited in claim 8 further including means for wiping excess ink from said design roller.

12. An improved pellet marking mechanism as recited in claim 11 wherein said means for wiping excess ink from said design roller comprises a doctor blade and means for reciprocally moving said doctor blade back and forth along the longitudinal axis of said design roller.

13. An improved mechanism as recited in claim 12 further including means connected to said doctor blade for moving said doctor blade between a position in which it contacts said design roller and a position in which it does not contact said design roller.

14. An improved pellet marking mechanism as recited in claim 13 further including a doctor blade safety bar mounted on said frame and covering said doctor blade when said blade is not in contact with said design roller.

15. An improved pellet marking mechanism as recited in claim 11 wherein said means for wiping excess ink from said design roller include a pair of scraper blades, each scraper blade fixedly mounted to said frame and bearing against a side portion of said design roller.

16. An improved pellet marking mechanism as recited in claim 7 wherein said positional adjustment means for adjusting the position of said design roller along the axial direction thereof comprises a bracket cantilevered to said frame, a bar slidably received in said bracket and being adapted for sliding movement back and forth along a direction parallel with the longitudinal axis of said design roller, a spool connected to said design roller, a finger carried by said slidable bar and being tracked in said spool to transfer sliding motion of said slidable bar to said design roller.

17. An improved pellet marking mechanism as recited in claim 1 further including safety means adjacent said printing roller for halting rotational movement of said printing roller.

18. An improved pellet marking mechanism as recited in claim 17 wherein said safety means comprises a safety bar spanning said printing roller, a cam follower carried by said safety bar, and cam means responsive to movement of said cam follower to halt rotational movement of said printing roller.

* * * * *